US005639161A

United States Patent [19]

Sirianni

[11] Patent Number: 5,639,161

[45] Date of Patent: Jun. 17, 1997

[54] PRESSURE SWITCH-CONTROLLED BLENDER CUP APPARATUS

[76] Inventor: Timothy J. Sirianni, 1842 Nautilus La., Hanover Park, Ill. 60103

[21] Appl. No.: 368,967

[22] Filed: Jan. 5, 1995

[51] Int. Cl.[6] ..... B01F 7/22

[52] U.S. Cl. ..... 366/314; 366/205; 366/206

[58] Field of Search ..... 366/64, 65, 130, 366/197, 205, 206, 242, 244–251, 314, 325, 601; 99/348

[56] References Cited

U.S. PATENT DOCUMENTS

| | | | |
|---|---|---|---|
| 1,480,914 | 1/1924 | Poplawski | 366/314 |
| 2,223,018 | 11/1940 | Christensen | 366/314 |
| 2,920,875 | 1/1960 | Marfuggi | 366/197 |
| 3,175,594 | 3/1965 | Jepson et al. | 366/205 X |
| 3,612,126 | 10/1971 | Emmons et al. | 366/205 X |
| 3,704,864 | 12/1972 | Lee | 366/205 |
| 4,435,084 | 3/1984 | Calhoun et al. | 366/130 |
| 4,487,509 | 12/1984 | Boyce | 366/206 X |
| 4,860,906 | 8/1989 | Pellegrini et al. | 215/12.2 |
| 4,887,909 | 12/1989 | Bennett | 366/205 X |
| 4,889,248 | 12/1989 | Bennett | 366/205 X |
| 5,425,579 | 6/1995 | Sampson | 366/314 X |

FOREIGN PATENT DOCUMENTS

| | | | |
|---|---|---|---|
| 2928107 | 1/1981 | Germany | 366/206 |

*Primary Examiner*—Charles E. Cooley

[57] ABSTRACT

A blender cup apparatus comprising a rigid hollow base having a top wall, a bottom wall, a peripheral side wall; a open cup coupled to the top wall of the base; a lid removably secured over the cup; a battery removably disposed within the base for supplying electrical energy; a motor having a fixed stator coupled to the battery and base and a rotatable rotor extended upwards through the top wall and into the cup with the stator imparting rotational motion to the rotor; a propeller coupled to the rotor of the motor within the cup; a power switch extended from the base and coupled to the battery; and a pressure switch extended from the base and coupled between the motor and power switch, the power switch having an enabled orientation for allowing delivery of electrical energy to the pressure switch and a disabled orientation for preventing such delivery, the pressure switch having a depressed orientation for allowing electrical energy to be delivered to the motor and further having a released orientation for preventing such delivery.

1 Claim, 4 Drawing Sheets

10
2
2
5
5
30
12
6
6

50
40
38

PRESSURE SWITCH-CONTROLLED BLENDER CUP APPARATUS

BACKGROUND OF THE INVENTION

1. Field of the Invention

The present invention relates to a blender cup apparatus and more particularly pertains to blending solid and liquid foods therein with a blender cup apparatus.

2. Description of the Prior Art

The use of blenders is known in the prior art. More specifically, blenders heretofore devised and utilized for the purpose of blending foods are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,588,004 to Herbert discloses a blender cup with pivotable measuring device mounted therein. U.S. Pat. No. 4,887,909 to Bennett discloses a blender with a thermally insulated container. U.S. Pat. No. 4,889,248 to Bennett discloses a combination container cap and blender adapter. U.S. Pat. No. 5,112,135 to Rupp discloses a mixer. U.S. Pat. No. 5,249,691 to Mizrahi discloses a miniature glass having a swizzle stick with an attachment capability to a drinking vessel.

While these devices fulfill their respective, particular objective and requirements, the aforementioned patents do not describe a blender cup apparatus that is readily transportable from one location to another and is deactivated and deactivated through the use of an integral pressure switch.

In this respect, the blender cup apparatus according to the present invention substantially departs from the conventional concepts and designs of the prior art, and in doing so provides an apparatus primarily developed for the purpose of blending solid and liquid foods therein.

Therefore, it can be appreciated that there exists a continuing need for new and improved blender cup apparatus which can be used for blending solid and liquid foods therein. In this regard, the present invention substantially fulfills this need.

SUMMARY OF THE INVENTION

In the view of the foregoing disadvantages inherent in the known types of blenders now present in the prior art, the present invention provides an improved blender cup apparatus. As such, the general purpose of the present invention, which will be described subsequently in greater detail, is to provide a new and improved blender cup apparatus and method which has all the advantages of the prior art and none of the disadvantages.

To attain this, the present invention essentially comprises, in combination, a rigid cylindrical plastic base. The base has a top wall, a bottom wall, a peripheral side wall, an intermediate wall extended across the side wall at a location between the top and the bottom wall, a first compartment and a second compartment formed therein, an openable door having an open orientation for allowing access to the first compartment and a closed orientation for preventing such access, and a central bore disposed through the top wall and intermediate wall for allowing access to the second compartment. A cup is included and formed of a lightweight impact-resistant plastic with a capacity for holding a volume of between about 12 to 16 ounces of liquid. The cup has a hollow frustral configuration with an open top end, an open bottom end coupled to the periphery of the top wall, and a peripheral side wall extended between the top end and the bottom end. The cup further has a thin exterior layer of generally soft and grippable rubber disposed thereon. A plastic lid is included and removably secured over the top end of the cup for holding food therein. A battery is provided and removably disposed within the first compartment for supplying electrical energy. A motor is included and has a fixed stator and a rotatable rotor with the stator coupled to the battery and the bottom wall of the base within the second compartment and with the rotor extended upwards through the central hole and into the cup. The stator imparts rotational motion to the rotor when electrically energized. A propeller is included and coupled to the rotor of the motor within the cup for blending food. The propeller has four elongated rigid blades extended outwards in quadrature from the stator. Each blade has a downwardly angled inner component and an upwardly angled outer component. A power switch is included and extended through the side wall of the base and coupled to the battery. Lastly, a pressure switch is included and extended through the bottom wall of the base and coupled between the motor and power switch. The power switch has an enabled orientation for allowing delivery of electrical energy to the pressure switch and a disabled orientation for preventing such delivery. The pressure switch has a depressed orientation for allowing electrical energy to be delivered to the motor and further having a released orientation for preventing such delivery.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved blender cup apparatus which has all the advantages of the prior art blenders and none of the disadvantages.

It is another object of the present invention to provide a new and improved blender cup apparatus which may be easily and efficiently manufactured and marketed.

It is a further object of the present invention to provide a new and improved blender cup apparatus which is of durable and reliable construction.

An even further object of the present invention is to provide a new and improved blender cup apparatus which is susceptible of a low cost of manufacture with regard to both materials and labor, and which accordingly is then susceptible of low prices of sale to the consuming public, thereby making such a blender cup apparatus economically available to the buying public.

Still yet another object of the present invention is to provide a new and improved blender cup apparatus which provides in the apparatuses and methods of the prior art some of the advantages thereof, while simultaneously overcoming some of the disadvantages normally associated therewith.

Even still another object of the present invention is to provide a new and improved blender cup apparatus for blending solid and liquid foods therein.

Lastly, it is an object of the present invention to provide a new and improved blender cup apparatus comprising a rigid hollow base having a top wall, a bottom wall, a peripheral side wall; a open cup coupled to the top wall of the base; a lid removably secured over the cup for holding food therein; a battery removably disposed within the base for supplying electrical energy; a motor having a fixed stator coupled to the battery and base and a rotatable rotor extended upwards through the top wall and into the cup with the stator imparting rotational motion to the rotor when electrically energized; a propeller coupled to the rotor of the motor within the cup for blending food; a power switch extended from the base and coupled to the battery; and a pressure switch extended from the base and coupled between the motor and power switch, the power switch having an enabled orientation for allowing delivery of electrical energy to the pressure switch and a disabled orientation for preventing such delivery, the pressure switch having a depressed orientation for allowing electrical energy to be delivered to the motor and further having a released orientation for preventing such delivery.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
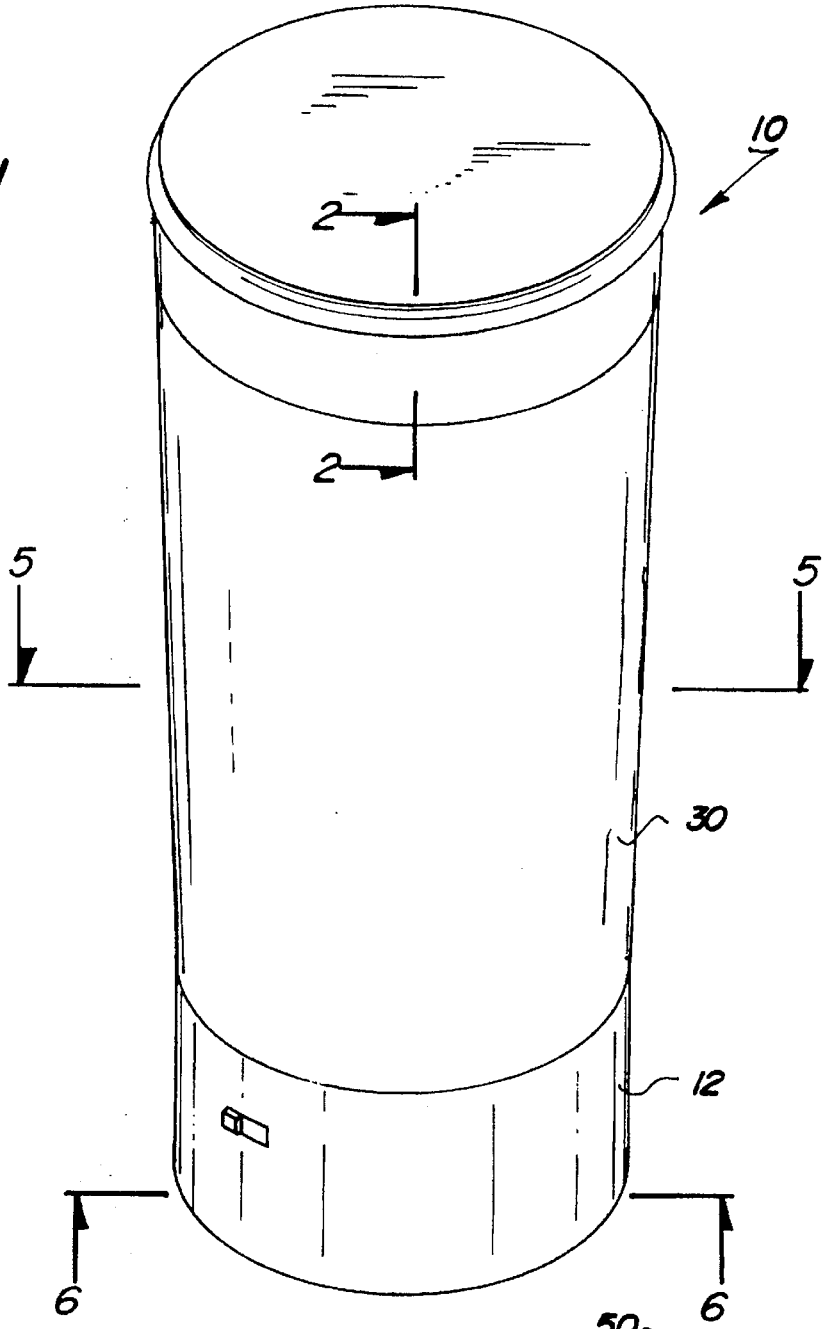
FIG. 1 is a perspective view of the preferred embodiment of the blender cup apparatus constructed in accordance with the principles of the present invention.
Figure 2:
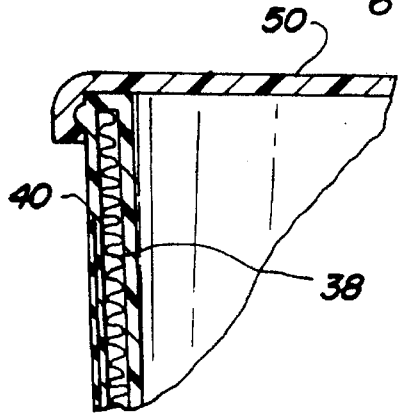
FIG. 2 is a cross-sectional view of the present invention taken along the line 2—2 of FIG. 2.
Figure 3:
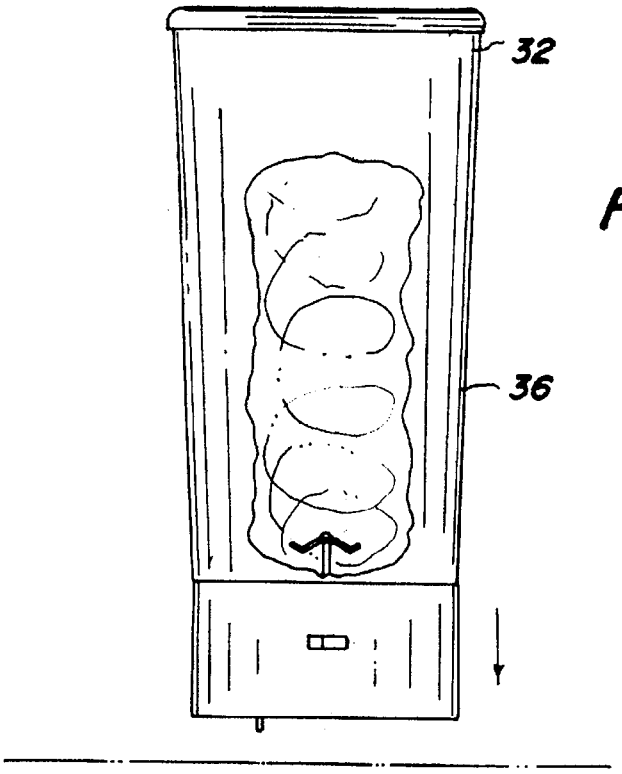
FIG. 3 is a side-elevational sectional view of the present invention with the pressure switch in a released orientation for preventing blending of food within the cup.
Figure 4:
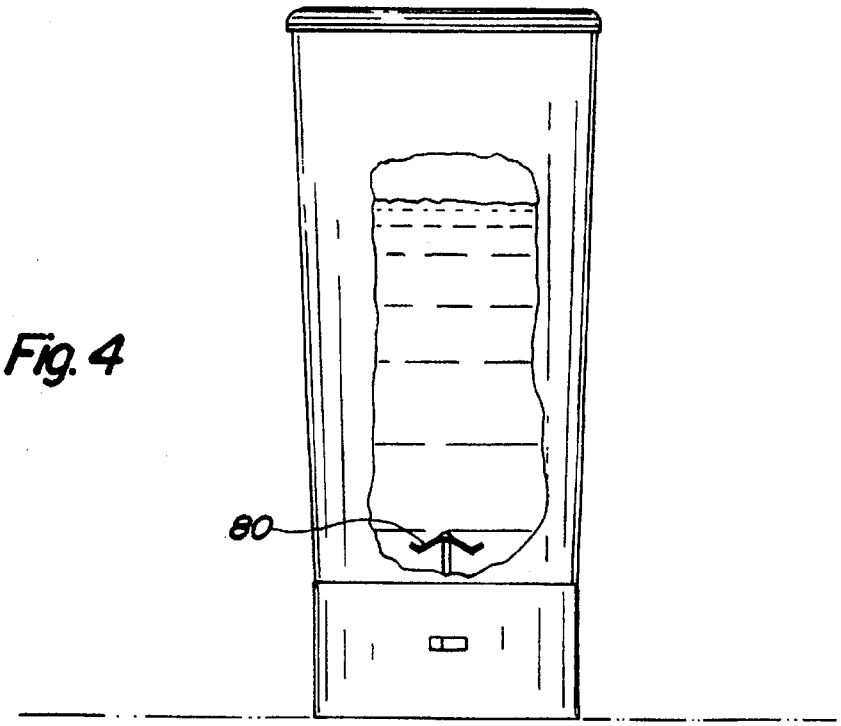
FIG. 4 is a side-elevational sectional view of the present invention with the pressure switch in a depressed orientation for allowing blending of food within the cup.
Figure 5:
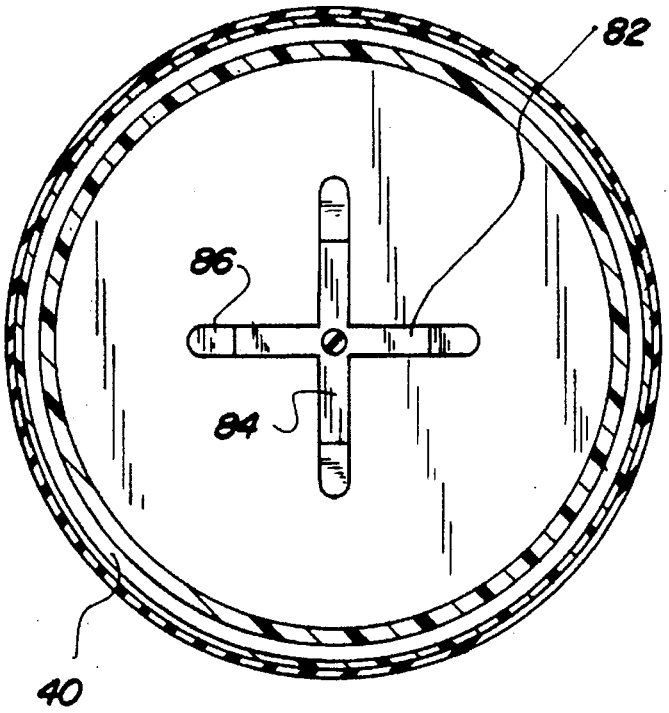
FIG. 5 is a cross-sectional view of the present invention taken along the line 5—5 of FIG. 1.
Figure 6:
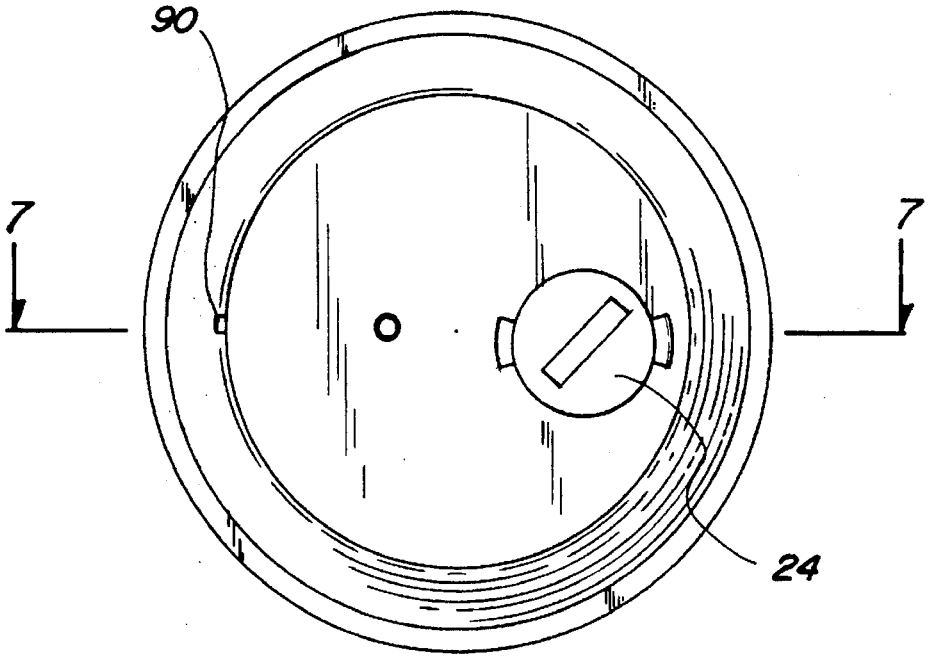
FIG. 6 is a view of the present invention taken along the line 6—6 of FIG. 1.
Figure 7:
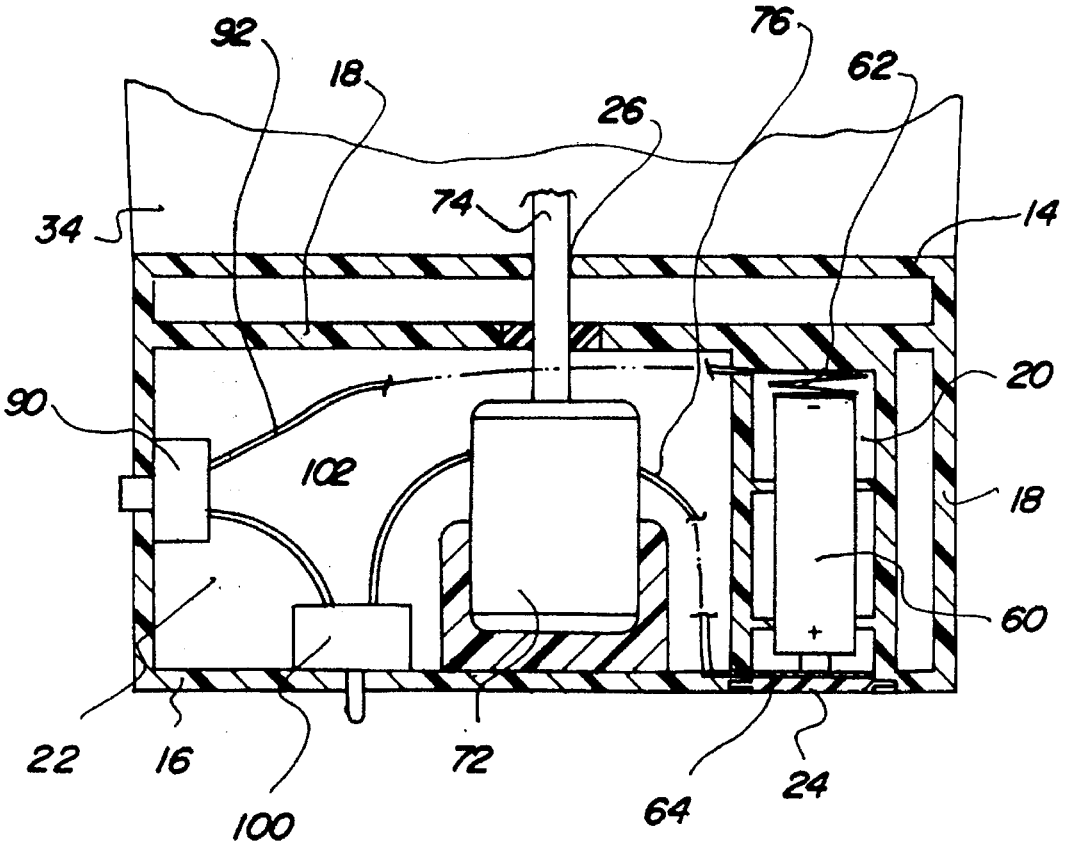
FIG. 7 is a cross-sectional view of the base of the present invention taken along the line 7—7 of FIG. 6.
Figure 8:
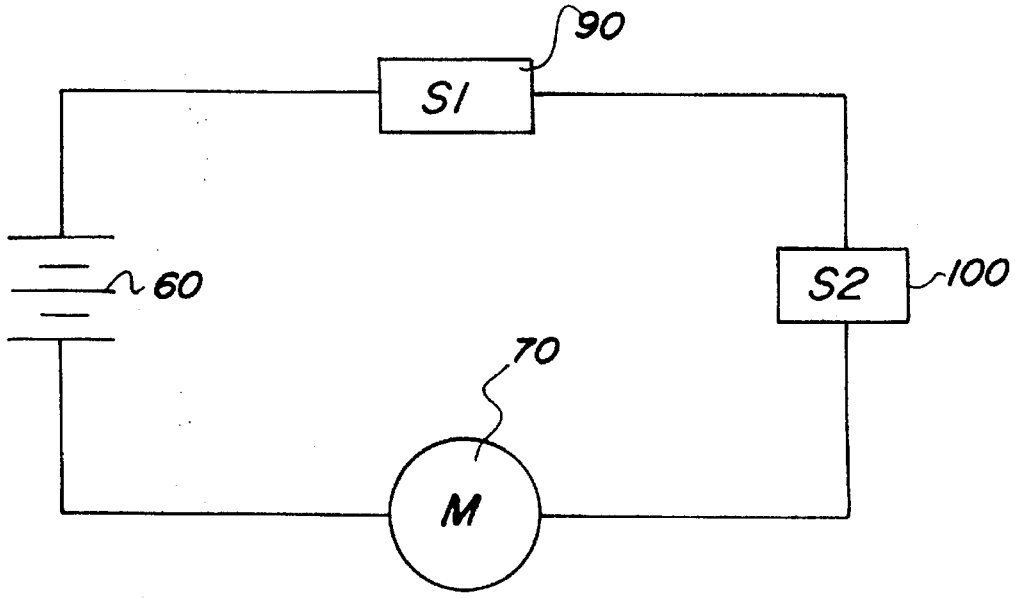
FIG. 8 is a schematic diagram of the electrical components of the present invention.

With reference now to the drawings, and in particular, to FIG. 1 thereof, the preferred embodiment of the new and improved blender cup apparatus embodying the principles and concepts of the present invention and generally designated by the reference number 10 will be described.

The present invention is comprised of a plurality of components. In their broadest context, such components include a base, a cup, a lid, a battery, a motor, a propeller, and a pair of switches. Such components are individually configured and correlated with respect to each other to provide the intended function of blending solid and liquid foods.

Specifically, the present invention includes a base 12. The base is rigid and cylindrical in structure. It is formed of an impact-resistant plastic or other similar rigid material. The base has a top wall 14, a bottom wall 16, and a peripheral side wall 18 extended between the top wall and bottom wall. Also provided is an intermediate wall 18 extended across the side wall at a location between the top and the bottom wall for providing the base additional stability. The base also includes a first compartment 20, and a second compartment 22 formed therein. Also provided is an openable door 24 disposed on the bottom wall. The door has an open orientation for allowing access to the first compartment and a closed orientation for preventing such access. The door includes a slot formed thereon. By turning the slot, the door may be released from the bottom wall or secured thereto. A central bore 26 is disposed through the top wall and the intermediate wall and allows access to the second compartment.

A cup 30 is included. The cup is formed of a lightweight impact-resistant and generally transparent plastic or other similar rigid material. The cup has a capacity for holding a volume of between about 12 to 16 ounces of liquid or processed solids. The cup has a hollow frustral configuration with an open top end 32 and an open bottom end 34. The open top end has a diameter larger than the bottom end. The axial length of the cup is at least twice as great as diameter of the bottom end. The bottom end is coupled to the periphery of the top wall 14 of the base. The cup also has a peripheral side wall 36 extended between the top end 32 and the bottom end 34. The side wall includes a layer of insulation 38 therein for containing heat within the cup or preventing heat from entering the cup. The cup further has a thin layer 40 of generally soft and grippable rubber disposed on the exterior of the cup. This rubber allows a user a firm hold of the present invention. Also provided is a plastic lid 50. The plastic lid is removably secured over the top end of the cup for holding food therein.

A battery 60 is removably disposed within the first compartment. The battery is held in place by an electrically conductive contact spring 62 positioned against its negative pole and a flat electrically conductive contact 64 coupled to the door and positioned against its positive pole. The battery is used for supplying electrical energy for operation. The battery is conventional in design and commercially available.

A motor 70 is also provided. The motor has a fixed stator 72 and a rotatable rotor 74. The motor is disposed within the second compartment of the base. The stator of the motor is coupled to the bottom wall 16 of the base. Furthermore, the stator is electrically coupled to the battery with an insulated wire 76. The rotor of the motor is extended upwards through the central bore 26 and into the lower portion of the cup. The stator imparts rotational motion to the rotor when electrically energized.

To blend food, a propeller 80 is coupled to the rotor 74 of the motor. The propeller is formed of metal or other similar rigid material. The propeller has four elongated blades 82. The blades are extended outwards in quadrature from the stator. Each blade has a downwardly angled inner portion 84 and an upwardly angled outer component 86. This blade configuration is highly effective in blending both solids and liquids. The propeller is removable for allowing ready cleaning of the cup.

Also provided is a power switch 90. The power switch is extended through the side wall of the base. The power switch is also electrically coupled to the battery with an insulated wire 92. Furthermore, a pressure switch 100 is extended through the bottom wall of the base and coupled between the motor and power switch with insulated wires 102. The power Switch has an enabled orientation for allowing delivery of electrical energy to the pressure switch. The power switch also has a disabled orientation for preventing delivery of electrical power to the pressure switch. Furthermore, the pressure switch has a depressed orientation for allowing electrical energy to be delivered to the motor. The pressure switch also has a released orientation for preventing such delivery.

To operate the present invention, solids, liquids, or combinations thereof are placed within the cup, and then the lid is secured over the cup. The power switch is placed in an enabled orientation. If the base is currently set on a recipient surface, the pressure switch is in the depressed orientation and thus starts the propeller revolving for blending the food. When the cup is lifted, the propeller stops, thereby preventing blending of food and allowing the cup to be opened and its blended contents emptied.

The present invention is utilized for blending powdered supplements, soft drinks, fruits, vegetables, and the like. The present invention is similar in design to conventional blenders but smaller in capacity and uses the convenience of battery power instead of electric power. The present invention is formed of two sections. First there is an upper section or cup which is made of plastic with a rubbery soft-grip material on the outer surface of the cup. The material provides an insulating and shock resistant effect for the cup. A flexible cap or lid tightly seals the top. The bottom section or base of the present invention features a housing inside of which there is a 9 volt or 12 volt motor and a battery. A propeller on the end of the stator of the motor extends up from the center of the housing into the cup for mixing purposes. There are two switches on the present invention. One is a power switch which is located near the bottom on one side of the base that enables or disables the motor. The other switch is a pressure switch which is located on the bottom of the unit. When the power switch is placed in the enabled orientation, mixing is accomplished by setting the unit down on a flat surface, thereby depressing the retractable switch on the bottom. With the power switch in the disabled orientation, placing the unit on the flat surface does not cause the motor to start. The present invention is less cumbersome to use than conventional blenders and can be operated anywhere because of its battery power.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A pressure switch-controlled blender cup apparatus for blending solid and liquid foods therein comprising, in combination:

a rigid cylindrical plastic base having a top wall, a bottom wall, a peripheral side wall, an intermediate wall extended across the side wall at a location between the top and the bottom walls, a first compartment and a second compartment, an openable door removably secured to the base and having an open orientation for allowing access to the first compartment and a closed orientation for preventing such access, and a central bore disposed through the top wall and intermediate wall for allowing access to the second compartment;

a cup formed of a lightweight impact-resistant plastic with a capacity for holding a volume of between about 12 to 16 ounces of liquid, the cup having a hollow frustral configuration with an open top end, an open bottom end coupled to the periphery of the top wall, and a peripheral side wall extended between the top end and the bottom end, the cup further having a thin exterior layer of generally soft and grippable rubber disposed thereon;

a plastic lid removably secured over the top end of the cup for holding food therein;

a battery removably disposed within the first compartment for supplying electrical energy;

a motor having a fixed stator and a rotatable rotor with the stator coupled to the battery and the bottom wall of the base within the second compartment and with the rotor extended upwards through the central bore and into the cup, the stator imparting rotational motion to the rotor when electrically energized;

a propeller coupled to the rotor of the motor within the cup for blending food, the propeller having four elongated rigid blades extended outwards in quadrature from the rotor, each blade having a downwardly angled inner component and an upwardly angled outer component;

a power switch extended through the side wall of the base and coupled to the battery; and a pressure switch extended through the bottom wall of the base and coupled between the motor and power switch, the power switch having an enabled orientation for allowing delivery of electrical energy to the pressure switch and a disabled orientation for preventing such delivery, the pressure switch having a depressed orientation for allowing electrical energy to be delivered to the motor and further having a released orientation for preventing such delivery.

* * * * *